US008245424B2

(12) United States Patent
Hill

(10) Patent No.: US 8,245,424 B2
(45) Date of Patent: Aug. 21, 2012

(54) ALTERNATING SIGN

(75) Inventor: G. Roland Hill, Cheshire (GB)

(73) Assignee: Contra Vision Ltd., Stockport (GB)

( * ) Notice: Subject to any disclaimer, the term of this patent is extended or adjusted under 35 U.S.C. 154(b) by 88 days.

(21) Appl. No.: 12/531,333

(22) PCT Filed: Mar. 17, 2008

(86) PCT No.: PCT/IB2008/051003

§ 371 (c)(1),
(2), (4) Date: Jan. 11, 2010

(87) PCT Pub. No.: WO2008/111024

PCT Pub. Date: Sep. 18, 2008

(65) Prior Publication Data

US 2010/0107459 A1 May 6, 2010

Related U.S. Application Data

(60) Provisional application No. 60/895,015, filed on Mar. 15, 2007.

(51) Int. Cl.
*A47F 11/06* (2006.01)

(52) U.S. Cl. ..... 40/427; 40/546; 40/559

(58) Field of Classification Search ..... 40/427, 40/615, 546, 559, 453, 454
See application file for complete search history.

(56) References Cited

U.S. PATENT DOCUMENTS 4,321,778 A * 3/1982 Whitehead ..... 52/204.591
5,152,089 A 10/1992 Bellico
5,682,697 A * 11/1997 Hjaltason ..... 40/615
5,782,026 A * 7/1998 Capie ..... 40/453
5,858,155 A 1/1999 Hill et al.
6,004,002 A * 12/1999 Giannone ..... 362/183
6,040,807 A * 3/2000 Hamagishi et al. ..... 345/6
6,212,805 B1 * 4/2001 Hill ..... 40/443
RE37,186 E * 5/2001 Hill ..... 428/187
6,242,076 B1 6/2001 Andriash (Continued)

FOREIGN PATENT DOCUMENTS

EP 1496489 A1 1/2005

(Continued)

OTHER PUBLICATIONS

International Search Report for International Patent Application No. PCT/IB2008/051003, mailed Sep. 25, 2008.

(Continued)

*Primary Examiner* — Gary Hoge
(74) *Attorney, Agent, or Firm* — Pillsbury Winthrop Shaw Pittman LLP

(57) ABSTRACT

An alternating sign assembly includes a sheet of light permeable material comprising a front surface and a rear surface; a front design that includes a front design layer; a silhouette pattern including light-restricting imaging material, said front design being superimposed on or forming a part of the silhouette pattern, said silhouette pattern subdividing said sheet into a plurality of discrete areas of said imaging material and/or a plurality of discrete areas devoid of said imaging material; a switchable front source of artificial illumination of said front design; a rear design disposed rearwardly of the front design; and a switchable rear source of artificial illumination of said rear design. The sources of illumination may be alternately turned on to make the front and rear designs alternately visible to an observer in front of the assembly.

32 Claims, 12 Drawing Sheets

U.S. PATENT DOCUMENTS

| | | | | |
|---|---|---|---|---|
| 6,490,819 | B1 * | 12/2002 | Kumata et al. | 40/615 |
| 6,971,758 | B2 * | 12/2005 | Inui et al. | 362/602 |
| 7,198,372 | B2 * | 4/2007 | Aeling et al. | 353/30 |
| 2004/0126618 | A1 | 7/2004 | Saito et al. | |
| 2006/0044228 | A1 * | 3/2006 | Emslander et al. | 345/76 |
| 2006/0046033 | A1 | 3/2006 | Emslander et al. | |
| 2006/0080874 | A1 * | 4/2006 | Eberwein | 40/564 |
| 2006/0120107 | A1 * | 6/2006 | Pao et al. | 362/612 |
| 2007/0234608 | A1 * | 10/2007 | Morrison | 40/546 |

FOREIGN PATENT DOCUMENTS

| | | | |
|---|---|---|---|
| EP | 1496490 | A2 | 1/2005 |
| GB | 2381116 | A | 4/2003 |
| WO | 2007010250 | A1 | 1/2007 |

OTHER PUBLICATIONS

Written Opinion of the International Searching Authority for International Patent Application No. PCT/IB2008/051003, mailed Sep. 25, 2008.

International Preliminary Report on Patentability for International Patent Application No. PCT/IB2008/051003, mailed on Apr. 14, 2009.

* cited by examiner

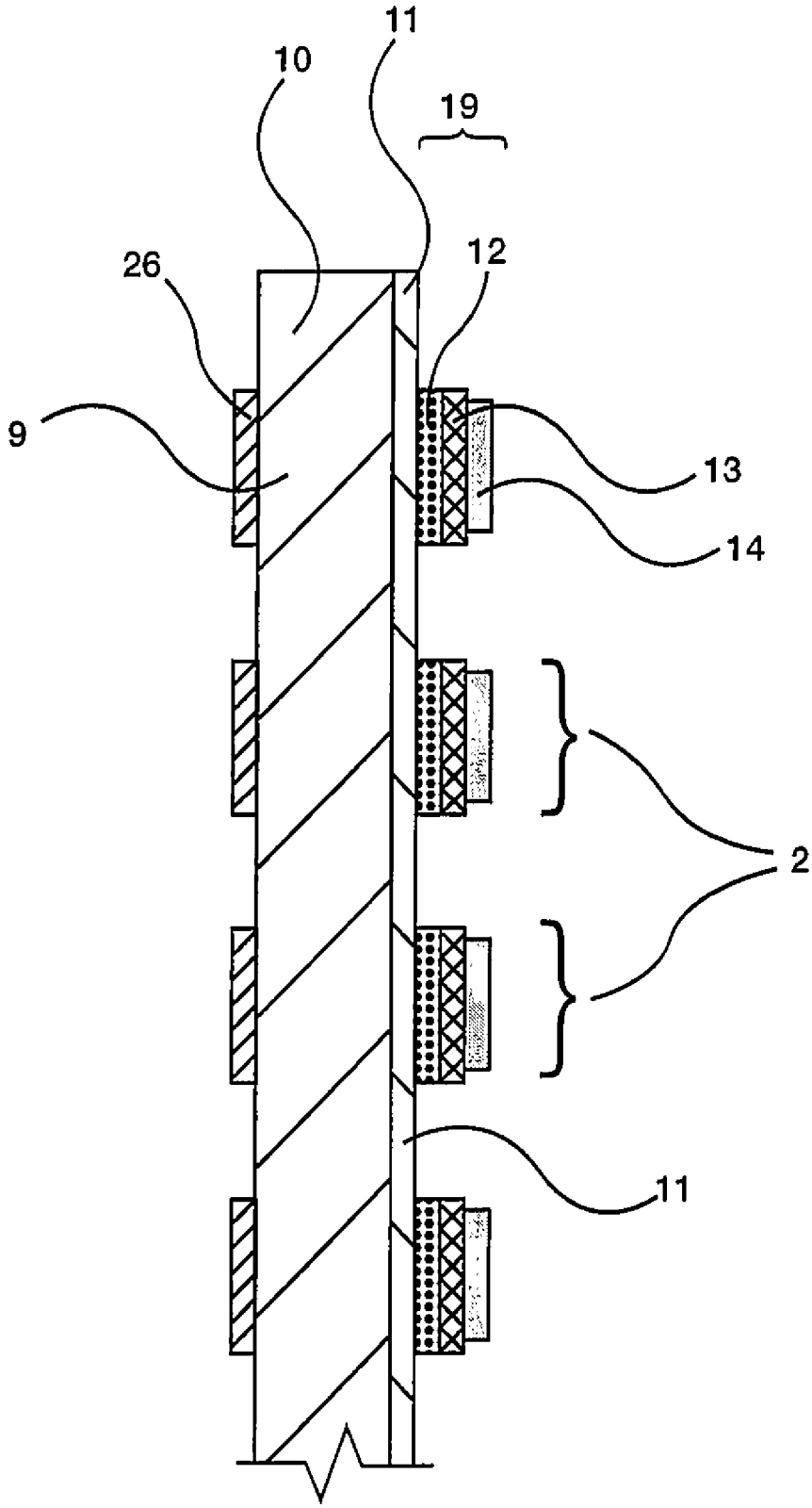
Fig. 11D X-X

ALTERNATING SIGN

CROSS REFERENCE TO RELATED APPLICATIONS

This is the U.S. National Phase of PCT/IB2008/051003, filed Mar. 17, 2008, which in turn claims priority to U.S. provisional application No. 60/895,015, filed Mar. 15, 2007, the contents of both of which are incorporated herein in their entirety by reference.

BACKGROUND OF THE INVENTION

1. Field of the Invention

The present invention relates generally to a sign assembly displaying alternating illuminated images.

2. Description of Related Art

An alternating sign assembly comprising a Contra Vision® panel according to U.S. RE37,186, comprising a partially imaged transparent material with a design superimposed on an opaque silhouette pattern was shown on BBC TV's Tomorrow's World in 1987, Contra Vision® being a trademark of Contra Vision Ltd (UK). The particular details of the Contra Vision® component or the other components of the assembly were not disclosed and there was no artificial source of illumination at the front of the assembly which was switchable to enhance visibility of the design, only the ambient lighting of a room in Sandringham Palace, UK, from where the TV programme was broadcast.

The color of signs can be changed by changing illumination, for example by 3M™ Dual-Color Film, a trademark of the Minnesota Mining and Manufacturing Company (USA). Also known from a sign display at New Look, Oxford Street, London, are rear projected images onto a rear projection screen placed behind a partially printed panel of uniform color.

SUMMARY OF EMBODIMENTS OF THE INVENTION

One or more embodiments of the present invention provides an assembly that includes a sheet of light permeable material comprising a front surface and a rear surface, a front design, a silhouette pattern comprising light-restricting imaging material, said front design being superimposed on or forming a part of the silhouette pattern, said silhouette pattern subdividing said sheet into a plurality of discrete areas of said imaging material and/or a plurality of discrete areas devoid of said imaging material, said front design comprising a front design layer, a switchable front source of artificial illumination of said front design, a rear design, a switchable rear source of artificial illumination of said rear design, said front source of artificial illumination and said rear source of artificial illumination being switchable to alternate the visibility of said front design and said rear design to an observer located in front of said assembly.

There are many different embodiments or variants to the invention, including different configurations of front and rear designs and different front and rear sources of artificial illumination, and the following descriptions should be regarded as selective examples and not limiting.

The front design is optionally applied to the front surface of the sheet of light permeable material or optionally applied to the rear surface of the sheet of light permeable material. The light permeable material is typically either a transparent or translucent imperforate material or a perforated material. The silhouette pattern is optionally applied to the front surface of the sheet of light permeable material or is optionally applied to the rear surface of the sheet of light permeable material or is optionally applied to the front or rear surface of another sheet of light permeable material or optionally comprises perforated material. The front design and silhouette pattern optionally comprise printed ink.

The rear design optionally comprises a rear design layer comprising translucent imaging material which is illuminated by the rear source of artificial illumination, the rear design typically comprising translucent imaging material, for example translucent inks or a photographic "transparency". Alternatively, the rear design is projected onto the sheet of light permeable material or onto another sheet of light permeable material, or the rear design comprises the rear source of artificial illumination.

According to a first embodiment of the invention, the silhouette pattern and design are applied to a sheet of imperforate light permeable material, typically both applied to either the front or rear surface of the sheet, and the rear design is applied to another sheet of imperforate light permeable material. The rear design is optionally applied to the front surface of the another sheet of light permeable material or the rear surface of the another sheet of imperforate light permeable material. The two sheets are typically located at the front of an illuminated sign box and one or both of the sheets is optionally replaceable, for example to show a product being advertised on one of the sheets and the different aspects or benefits of the product on the other, periodically changed, sheet.

A second embodiment is similar to the first embodiment except that the rear design is applied to the rear side or surface of said sheet of light permeable material. The sheet of imperforate light permeable material is typically located at the front of an illuminated sign box or enclosure and is optionally replaceable to enable the alternating sign or advertisement images to be changed from time to time.

In a third embodiment, the sheet of light permeable material comprises a perforated material which also forms the silhouette pattern on which the front design is superimposed, and the rear design is typically applied to another sheet of imperforate material. For example, a white on black perforated self-adhesive vinyl known in the art of one-way or see-through window graphics is imaged with a design, for example by digital inkjet printing, and adhered to the front of a transparent acrylic sheet, onto which a four color process rear design has been printed reverse-reading on the rear side, backed up by a translucent diffusing white layer, either printed or a further sheet of acrylic, for example of "opal" translucent white color.

In a fourth embodiment, the rear design is projected optionally onto the sheet of light permeable material or optionally onto another sheet of light permeable material or comprises the rear source of artificial illumination. In this fourth embodiment, the rear design is optionally a projected transparency, a projected moving image, or the rear design comprises the rear source of artificial illumination, for example in a fixed or programmable array of linear light sources, for example of neon tubes, or point light sources, for example a fixed or programmable array of Light Emitting Diodes (LEDs).

Illumination of the assembly is arranged such that an observer in front of the assembly can optionally see the front design illuminated by the front source of artificial illumination and/or see the rear design illuminated by the rear source of artificial illumination. Visibility of the front design and the rear design is typically alternated by means of the switchable front and rear sources of illumination. Optionally the transition from the front source of artificial illumination of the front design to the rear source of artificial illumination of the rear design is instantaneous or is effected by dimmable switchgear for one or both sources of illumination, for example the visible image gradually changing or "dissolving" from one to the other, and vice versa.

The front source of artificial illumination optionally:

(i) is located remote from the front design, for example a floodlight or spotlight located in a ceiling directed onto the front design, or (ii) is an integral part of a sign box assembly, located in front of and adjacent to the front design, typically outside the space defined by a forward geometric projection of the front design and optionally having a reflector behind or a prism in front of the source of illumination, to even out the level of illumination of the front design to some degree, typically according to a prior art method, sometimes referred to as a blackboard or a shelf source of illumination, or (iii) comprises edge-lighting to a front sheet of transparent material. If the front sheet is edge-lit and the silhouette pattern is opaque, the front design and silhouette pattern are typically applied to the rear surface of the sheet of transparent material; if the silhouette pattern is translucent, the design and silhouette pattern can be applied to the front or rear surface of the sheet of transparent material, or (iv) comprises an electroluminescent layer of the silhouette pattern, for example according to U.S. Pat. No. 6,242,076 or PCT/GB2006/002684, or (v) comprises a projector which projects the front design of a fixed or moving image.

The rear source of artificial illumination optionally:

(a) comprises a single light source or array of light sources located immediately behind the rear design, typically in a light box, (b) comprises an edge-lit panel, for example a row of LEDs along one or more edges of another sheet of light permeable material, illuminating an array of printed or etched dots, for example in the manner of a Prismex™ back-lit sign, Prismex being a trademark of Lucite International (UK), or (c) comprises a projector which projects the rear design of a fixed or moving image, or (d) comprises the rear design, for example a fixed or programmable array of LEDs.

The silhouette pattern is optionally opaque, for example as part of a panel according to U.S. RE37,186 or, as another example, is a translucent base pattern according to U.S. Pat. No. 6,212,805. In the latter case both designs are typically visible at the same time and it is the dominance of one or the other design which alternates. The front design layer and/or silhouette pattern optionally comprise a printed imaging material, for example ink, for example applied by screen printing or litho printing or digital printing. Optionally, the silhouette pattern comprises a cut film material, for example perforated self-adhesive vinyl according to U.S. Pat. No. 5,858,155 applied to the sheet of light permeable material, or cut self-adhesive vinyl stripes according to PCT/GB2006/002684 applied to the sheet of light permeable material.

Depending on the location of the assembly, the front design is optionally also illuminated by ambient lighting, for example daylighting or ambient artificial lighting, for example within a retail store. Preferably, the ambient lighting is of a sufficiently low level to enable to the rear source of artificial illumination to illuminate the rear design to an extent such that it has a relatively high level of illumination compared to the ambient illumination of the front design, such that an observer is primarily aware of the rear design, which may be said to "burn through" the front design. Optionally, both images are illuminated at the same time in a programmed sequence of illumination and optionally both front and rear sources of illumination are switched off so that the rear design is not visible and the front design is only visible by virtue of ambient illumination in front of the assembly.

The sheet of light permeable material and the another sheet of light permeable material, if present in an assembly, are each optionally a translucent white or so-called neutral translucent colour or etch effect, to render images behind the sheet less visible, or are optionally a proprietary transparent or translucent rear projection screen material, for example Perspex® Clear Vision, a trademark of Lucite International.

The front design typically comprises a uniform color or a plurality of colors, for example a spot color on a white silhouette pattern or a four color process image on a white silhouette pattern or a multicolor projected image onto a white silhouette pattern.

The rear design typically comprises a plurality of colors, for example a photographic transparency or a printed four or six color process image, or a projected transparency or moving image or a single color or multiple color LED display, for example a red green blue LED display.

Optionally the rear surface of the silhouette pattern is reflective, for example a white or silver color, to enhance the visibility of the rear design by light from the rear source of artificial illumination being reflected from the rear of the silhouette pattern.

Optionally the rear source of the artificial illumination is divided into a plurality of areas of illumination each illuminating or comprising a design or part of a design, which can be independently and separately switched, for example by means of a printed circuit or computer, and is optionally programmable into a required sequence of illumination, typically alternating with the illumination of the front design by the front source of artificial illumination.

The front and rear sources of artificial illumination are preferably easily switchable without substantially reducing the lifespan of the front and rear sources of artificial illumination, for example comprising one or more sources of LED illumination in preference to one or more fluorescent tubes, the latter being difficult to switch on and off instantaneously, a process which also reduces the lifespan of a fluorescent tube. Alternative sources of front and rear artificial illumination include cold cathode tubes, neon tubes and incandescent sources of illumination.

Optionally, the rear design comprises a plurality of different images interlaced in the manner of images printed onto a lenticular lens, typically in a pattern of thin lines of two, three or four images in sequence, in which case the front silhouette pattern typically comprises an opaque pattern of lines, the two patterns of lines being parallel to and the gap between the lines of the silhouette pattern being of similar width to the width of a single frame of the interlaced images of the rear design. The front design and silhouette pattern are, for example, applied to the front of a sheet of transparent material of sufficient thickness or positioned sufficiently remote from the interlaced images to achieve a 3D or changing image effect with relative movement of the observer to the assembly, in the manner of a lenticular display. The gaps between the lines of the silhouette pattern only reveal one of the interlaced images or a dual or transition image comprising adjacent frames. Thus, for example, a 3D or changing rear design image can be alternated with a front design image.

If the front design is conventionally edge-lit and superimposed on a uniform silhouette pattern, for example of dots or lines, on a transparent sheet of uniform thickness, the design will not typically be illuminated evenly but be more illuminated the closer to the source of edge lighting, unless special measures are taken. The edge lighting is internally reflected, for example within a transparent sheet of acrylic, until incident upon a portion of the front design, where it is scattered, a proportion of the light being emitted to cause the design to be visible to an observer in front of the assembly. A proportion of the light is therefore dissipated as it progresses through the acrylic sheet, causing a reducing level of illumination of the design. There are several means to overcome this effect, for example the silhouette pattern is typically orientated at an angle to the source of edge lighting, or is distributed such that there is greater concentration of imaged portions the further away from the edge lighting source of the illumination, or the front panel is wedge-shaped, typically a cast wedge of acrylic, in order to more evenly illuminate the design across the area of the panel. As one example, the silhouette pattern is disposed to be intercepted by the internally reflected rays of light more evenly across the surface of the acrylic sheet, for example by arranging the source of edge lighting to be substantially unidirectional perpendicular to the edge and aligning a pattern of lines or orthogonal array of dots at a very small angle to perpendicular to the edge, to allow uninterrupted internal reflection for the desired proportion of light from an edge position until it is incident on a printed portion, to achieve substantially uniform distribution of illumination of the front design.

Switchgear may operatively connect to the switchable front and rear sources of artificial illumination to alternately light the front and rear sources of artificial illumination.

Any combination of one or more components (e.g., the front and rear designs, the front and rear sources of illumination, etc.) of the assembly may be mounted to the sign box.

Additional and/or alternative objects, features, aspects, and advantages of the present invention will become apparent from the following description, the accompanying drawings, and the appended claims.

BRIEF DESCRIPTION OF THE DRAWINGS

For a better understanding of embodiments of the present invention as well as other objects and further features thereof, reference is made to the following description which is to be used in conjunction with the accompanying drawings, where:

FIGS. 11A-D are large-scale diagrammatic cross-sections through individual portions of the silhouette pattern and sheet of light permeable material.

DETAILED DESCRIPTION OF EXEMPLARY EMBODIMENTS OF THE INVENTION

FIGS. 1-4 relate to the first embodiment of the invention.

Figure 1:
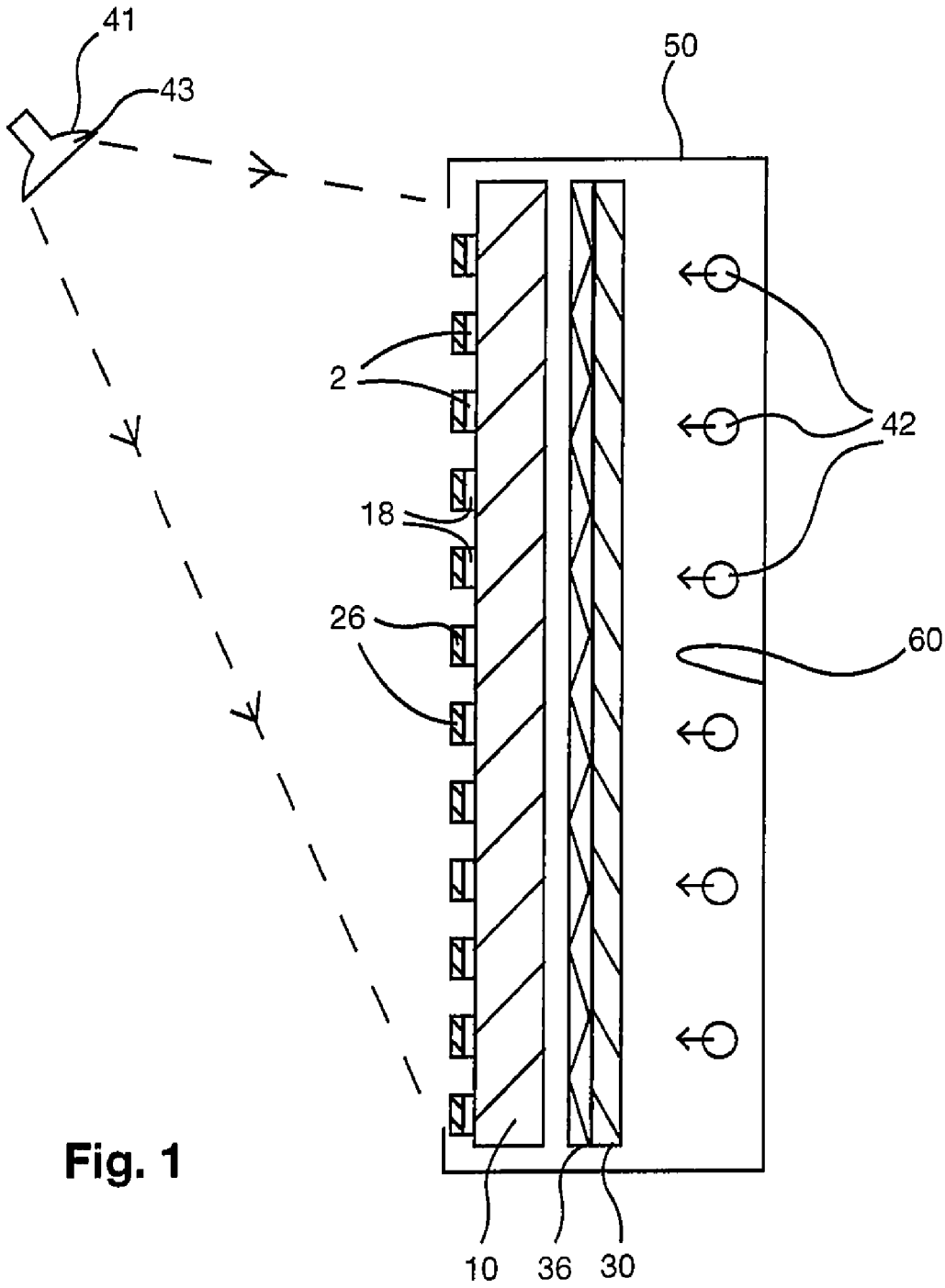
FIGS. 1-10 are diagrammatic cross-sections through assemblies of the invention.

FIG. 1 illustrates front design 26 superimposed on base layer 18 of silhouette pattern 2 applied to light permeable material 10, typically an imperforate transparent sheet, for example of glass, acrylic, polycarbonate or pvc. Base layer 18 is typically opaque, for example opaque white, or white on black, or white on silver inks, for example printed in exact registration with the front design layer 26, for example as disclosed in U.S. RE37,186. Front design 26 is capable of illumination by switchable front source of artificial illumination 41, for example spotlight 43 directed onto front design 26. Rear design 36, for example a photographic or printed image, is applied to another sheet of light permeable material 30, typically translucent, for example an opal acrylic sheet, which is capable of diffusing light from switchable rear source of artificial illumination 42, for example an array of LED ribbons, cold cathode tubes, neon tubes or fluorescent tubes, contained within the sign box casing or enclosure 50, for example of plastic or sheet metal, preferably aluminum, preferably with an internal reflective surface 60. When the rear source of artificial illumination 42 is not switched on, design 26 is visible from the front of the assembly through ambient lighting and/or the artificial source of illumination 41. When front artificial source of illumination 41 is switched off and rear source of artificial illumination 42 is switched on, rear design 36 is visible through the gaps between silhouette pattern 2. Typically, the power of illumination of rear source of artificial illumination 42 is such that visibility of rear design 36 is substantially greater than the visibility of front design 26 and preferably dominates or "burns through" front design 26. If the two sources of illumination 41 and 42 are switched on and off alternately, the image is seen to change to an observer located in front of the assembly between front design 26 and rear design 36. Optionally, the switching is faded or dimmed to achieve a gradual transfer from one image to the other. Optionally, light permeable material 10 is of a neutral tint to reduce the visibility of rear design 36, when not illuminated by rear source of artificial illumination 42. Optionally, sources of rear illumination 42 are programmed to illuminate different areas of rear design 36 sequentially before and after or interspersed with visibility of front design 26. Alternatively, designs 26 and 36 can be alternated and also illuminated simultaneously by sources of illumination 41 and 42 to produce a combined or composite image, for example rear design 36 comprises the brand name of a product illustrated in front design 26 and the two designs can be seen separately or superimposed.

Figure 2:
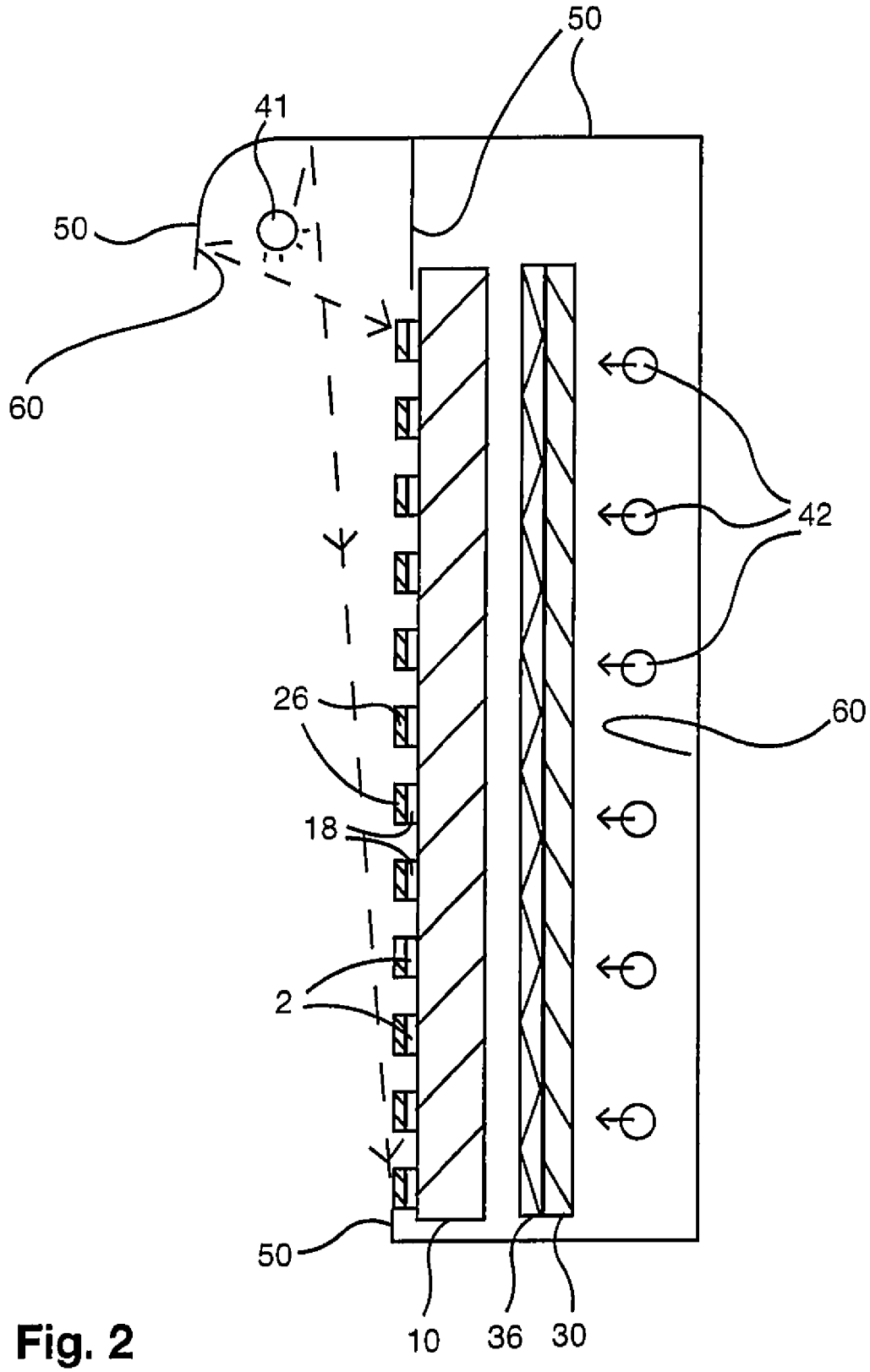

FIG. 2 illustrates a similar assembly to FIG. 1 except that enclosure 50 extends in front of and over front design 26, for example to mask a proportion of ambient lighting and/or to act as a reflector to front source of artificial illumination 41 by means of reflective surface 60, in order to distribute the illumination of front design 26 to achieve more uniform illuminance of design 26 than would otherwise result from a single source of illumination located at one edge of the assembly. Example front sources of artificial illumination include an LED ribbon, an LED bar, a cold cathode tube, a neon tube or a fluorescent tube. Optionally there is a prism or lens between the light source and the front design 26 to redistribute light to obtain a relatively even illumination of front design 26.

Figure 3:
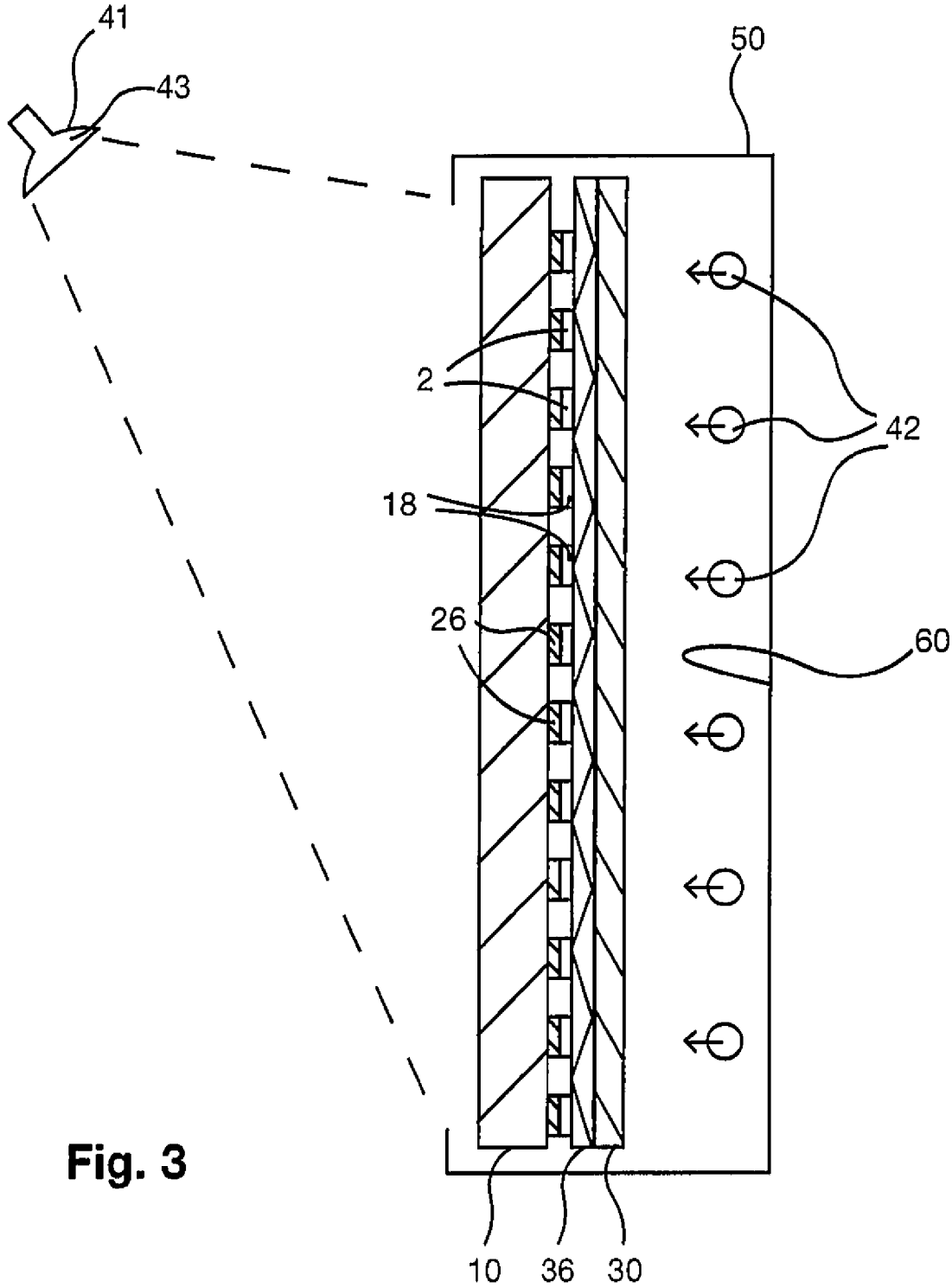

FIG. 3 is similar to FIG. 1 except that front design 26 is applied to the rear surface of light permeable material 10 and is overlain by base layer or layers 18 of silhouette pattern 2. This arrangement protects the imaged portions, for example from abrasion or chemical attack.

The rear source of artificial illumination 42 in FIGS. 1-3 can be any source of artificial illumination that is switchable and/or dimmable to achieve the desired alternating sign effects. Traditionally, back-lit signs have been illuminated by an array of fluorescent light tubes but fluorescent lights are not typically efficiently switchable, fluorescent lights are not typically switchable on and off instantaneously, and repeated switching tends to substantially lower the lifespan of the fluorescent light tubes. While fluorescent light tubes can be dimmed to be almost invisible, to avoid switching them off entirely, they are not an efficient means of providing rear source of artificial illumination 42, but can nonetheless be used without deviating from the scope of the present invention. Incandescent lights can be used but the lifespan of these is also substantially reduced by frequently switching them on and off. Preferably, cold cathode tubes, neon tubes or, more preferably, LED light sources are used to provide rear sources of illumination 42. Arrays of LED light sources are manufactured in "tiles", which can be assembled together to cover the required area of the sign. The "tiles" are optionally linear comprising LED ribbons or tapes of LED's in a single line or plurality of lines that are spaced to provide the required level of illumination.

Figure 4:
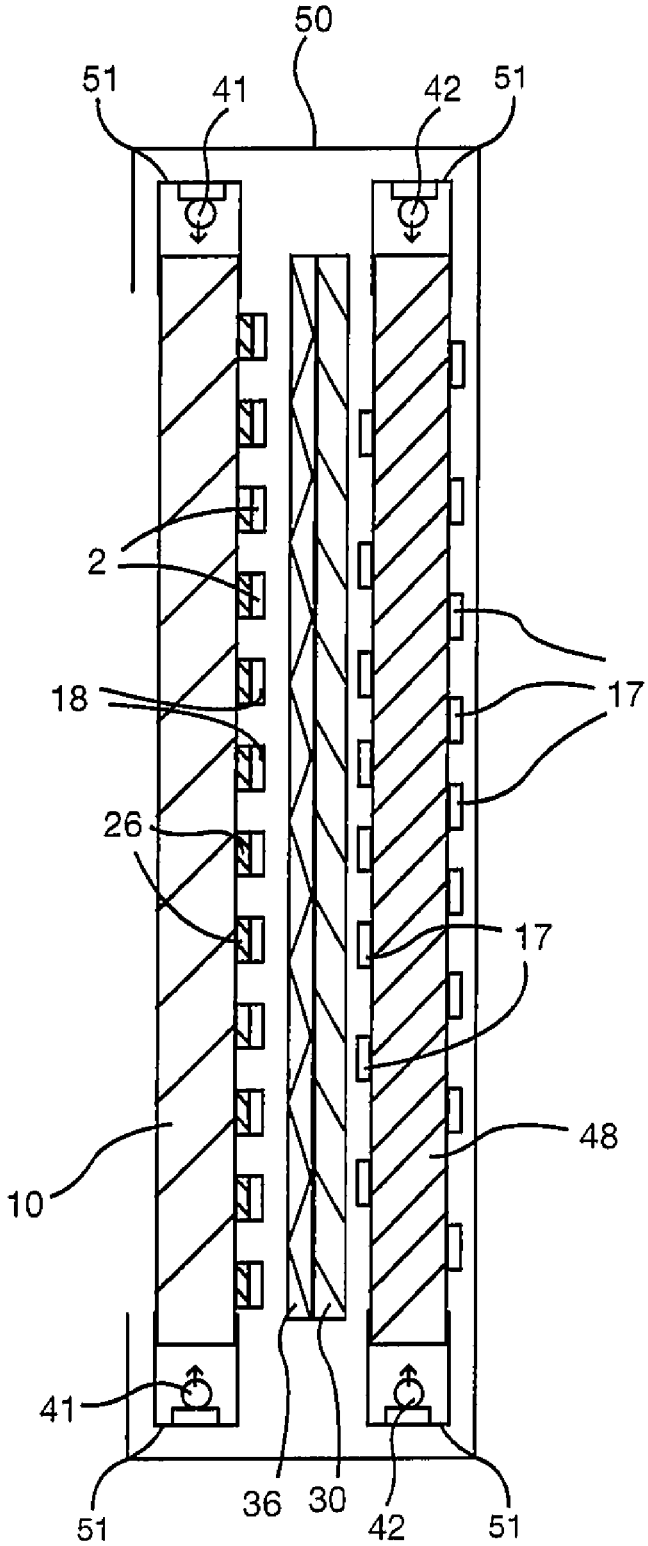

FIG. 4 has a sheet of light permeable material 10 imaged in a similar fashion to that in FIG. 3 but is edge-lit by front source of artificial illumination 41 surrounded by edge lighting channel 51 which ensures that light emitted from front source of artificial illumination 41 enters the edge of light permeable material 10, typically a transparent sheet, for example of acrylic, and is internally reflected until incident upon the imaged portions of design 26, whereupon the light is scattered and emitted through the front surface of sheet 10, to be visible by an observer in front of the assembly. Rear design 36 can optionally be illuminated as described for FIGS. 1-3 or optionally illuminated by another edge-lit panel, for example a sheet of Prismex™, a trademark of Lucite International, typically comprising an array of white or etched dots 17 edge-lit by rear source of artificial illumination 42. White or etched dots 17 are typically distributed in a more concentrated fashion remote from the edge-lit side or sides than near the edge-lit side or sides to more evenly distribute the light emitted to illuminate rear design 36. Sources of edge lighting 41 and 42 optionally include fluorescent tubes but preferably cold cathode or neon tubes, or more preferably, strips, ribbons or tapes of LED lights are incorporated within edge lighting channels 51.

Figure 5:
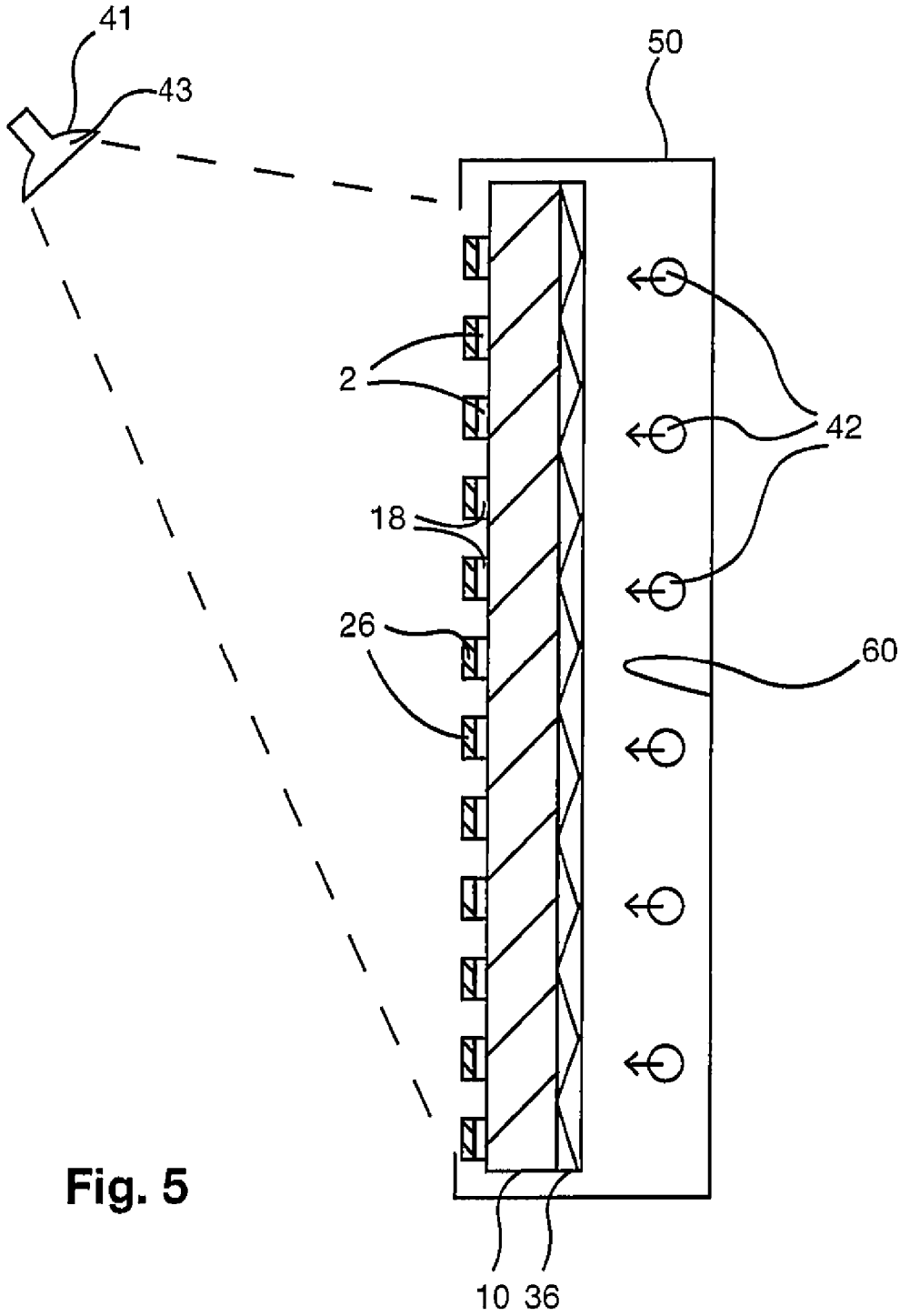

FIG. 5 is similar to FIG. 1 except that rear design 36 is applied to the rear surface of light permeable material 10, according to the second embodiment of the invention. Optionally the front source of artificial illumination is incorporated into the alternating sign box 50 as shown in FIG. 2. FIG. 5 can also be understood to illustrate the third embodiment of the invention, for example in which base layer 18 comprises solid portions of a perforated self-adhesive vinyl applied to the front side of an imperforate, transparent acrylic sheet, the rear side of which is printed with rear design 36.

Figure 6:
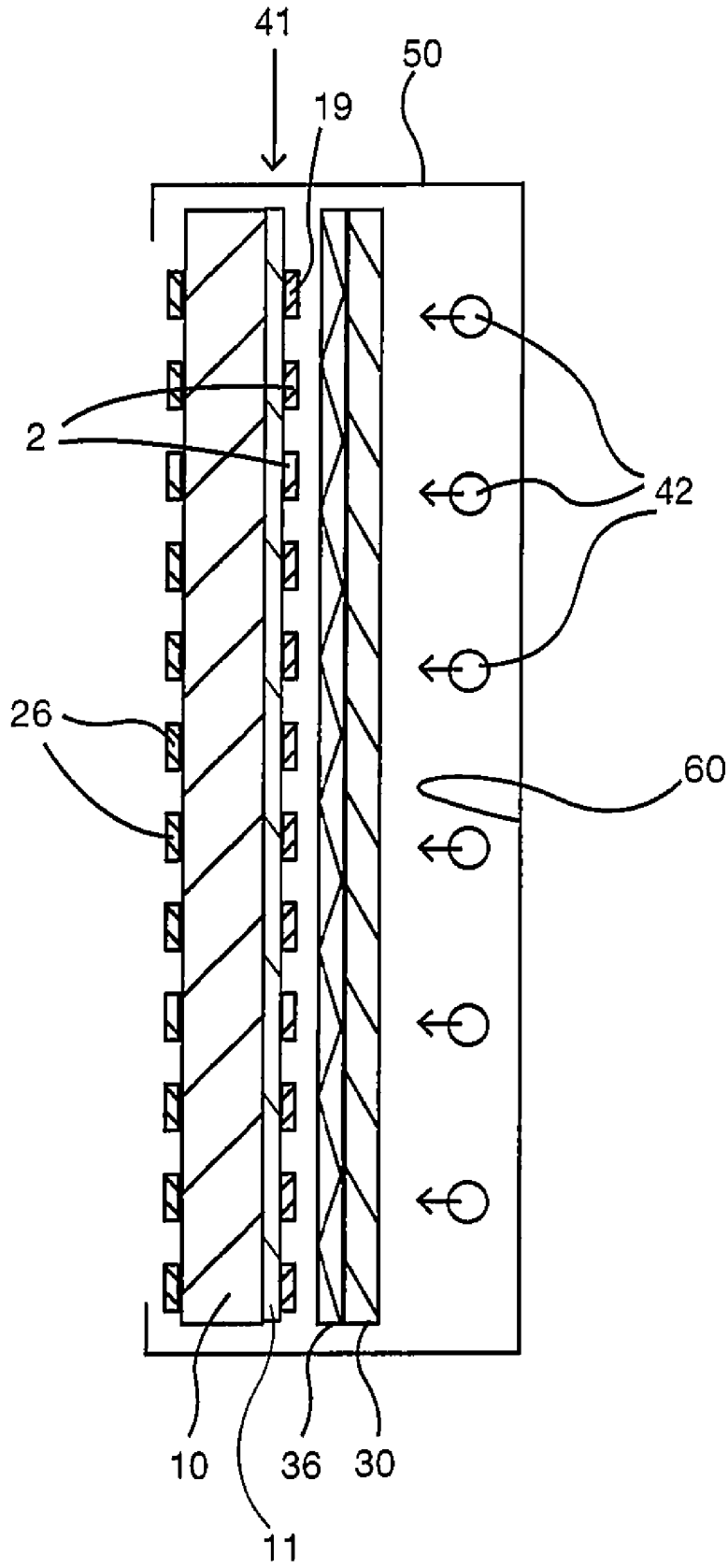

FIG. 6 is similar to FIG. 1 except that design layer 26 is applied to the front surface of light permeable material 10 within silhouette pattern 2. Front source of artificial illumination 41 comprises electroluminescent lamp 19 selectively applied to electrically conductive coating 11 applied to the rear surface of light permeable material 10 within silhouette pattern 2, for example in accordance with PCT/GB2006/002684. Front design 26 is illuminated by a layer of electroluminescent ink within electroluminescent silhouette pattern 19. Optionally front design 26 is applied to an additional, changeable sheet, for example of polyester film, and registered with silhouette pattern2, for example as disclosed in PCT/GB2006/002684.

Figure 7:
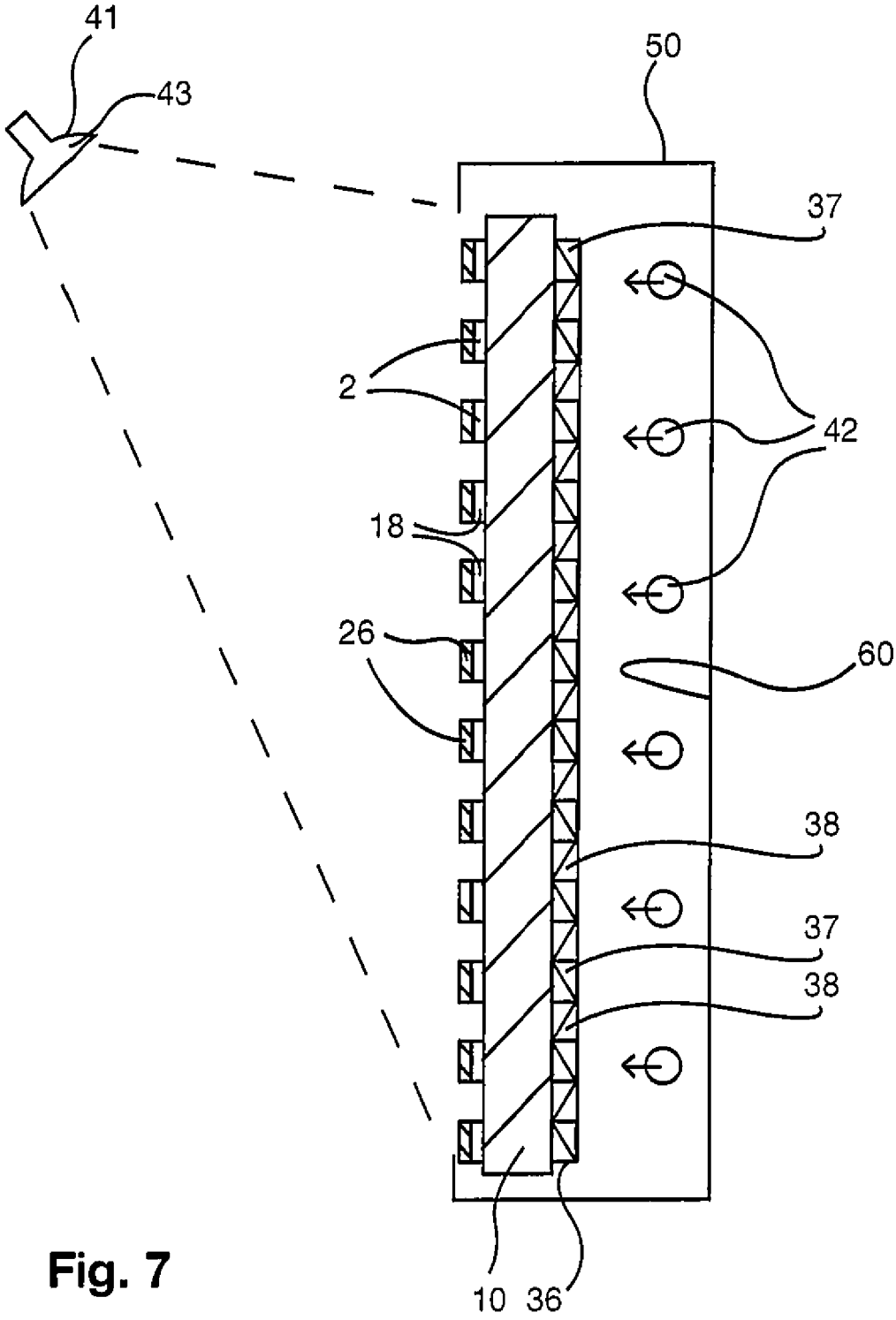

FIG. 7 is similar to FIG. 5 except that rear design 36 comprises interlaced images 37 and 38 akin to the interlaced images of lenticular signs. Silhouette pattern 2 comprises a pattern of lines parallel to and with gaps of the same width as the interlaced "frames" of rear design 36. Such an arrangement allows either a 3-D image of rear design 36 or changing images 37 and 38 to be visible by means of rear source of artificial illumination 42, resulting from relative movement of the sign to an observer or vice versa. For example, the silhouette pattern lines 2 and interlaced frames 37 and 38 are vertical such that either image 37 or 38 is visible to an observer passing in front of the assembly when rear source of artificial illumination 42 is switched on, alternating with front design 26 when rear illumination is switched off, preferably enhanced by front source of artificial illumination 41.

Figure 8:
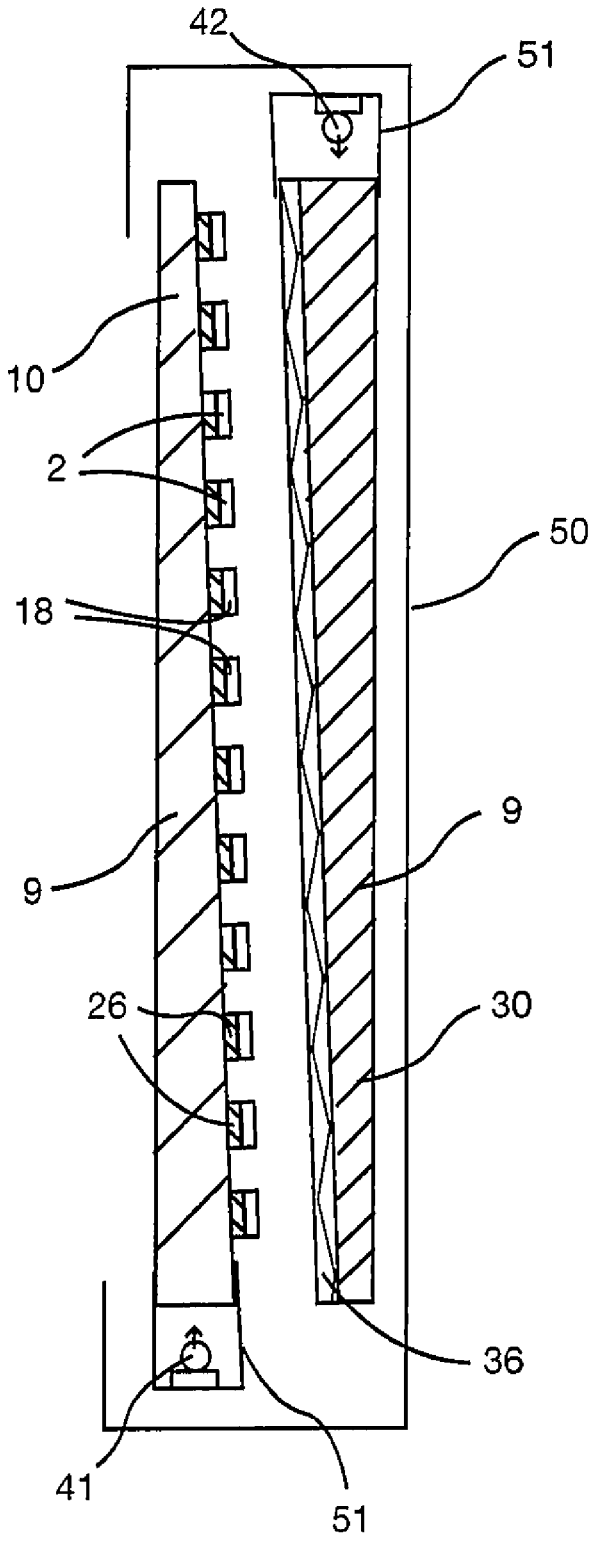

FIG. 8 is similar to FIG. 4 except that an edge lighting system is used comprising transparent panels 9 of wedge-shaped cross-section, for example acrylic wedges cast between two sheets of glass disposed at an angle to each other, a prior art method of distributing illumination away from a single source of edge lighting, to achieve relatively uniform illumination of an applied image. In the prior art use of this technique, a translucent design, for example a printed sheet of paper, is applied to one surface of the wedge-shaped panel. According to the present invention, there is the novel application of front design 26 and a uniform silhouette pattern 2 comprising base layer 18 applied to the rear surface of a wedge-shaped sheet of light permeable material 10, for example of clear acrylic. The rear design 36 is optionally applied to another wedge-shaped sheet of light permeable material 30 or, for example, is optionally illuminated by the arrangement of FIG. 1.

Figure 9:
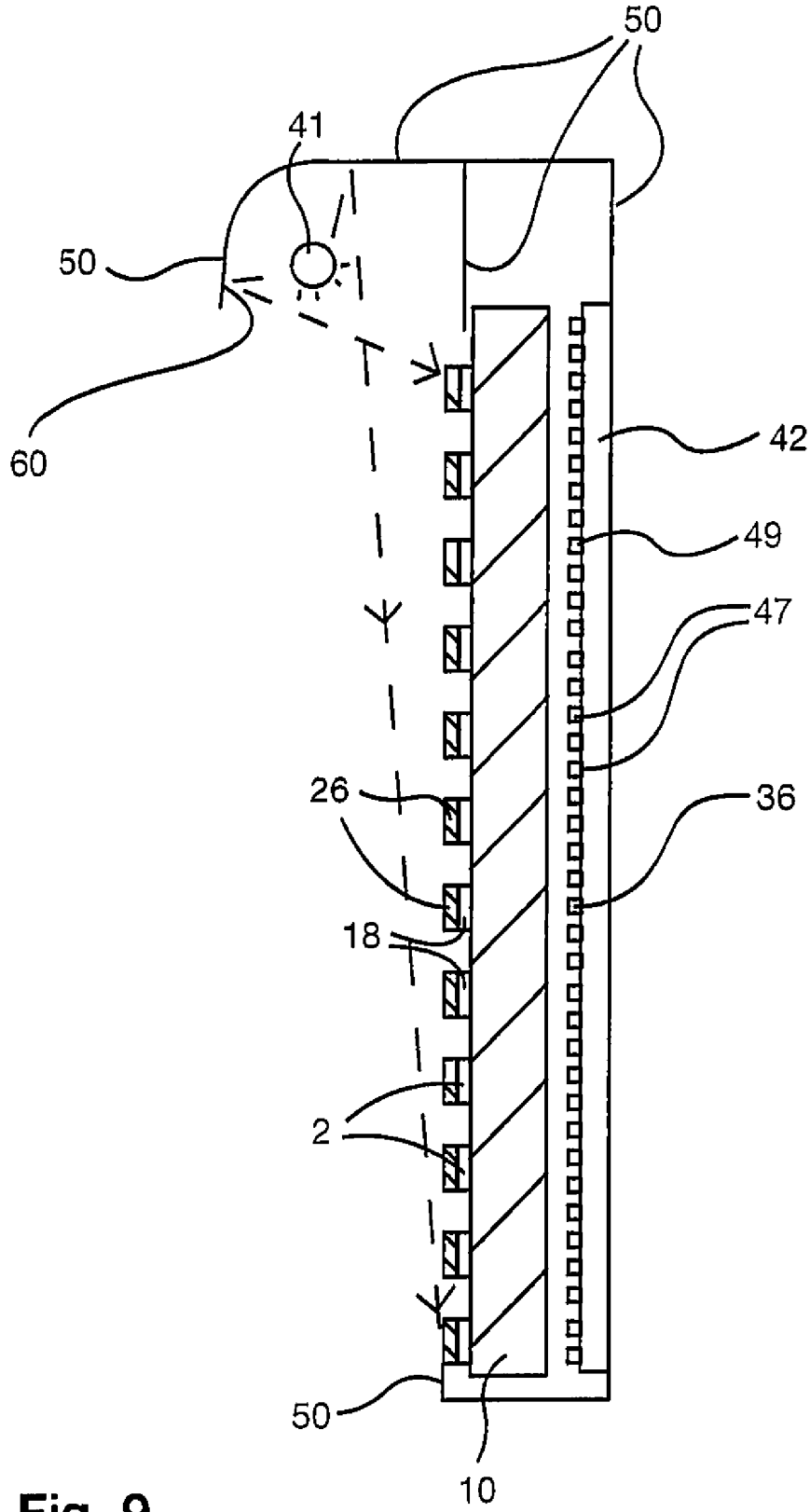

FIG. 9 illustrates an alternating sign assembly in sign box 50, the front design and the front source of artificial illumination being similar to those in FIG. 2. Rear design 36 comprises rear source of artificial illumination comprising a fixed or programmable array of LEDs 49.

Figure 10:
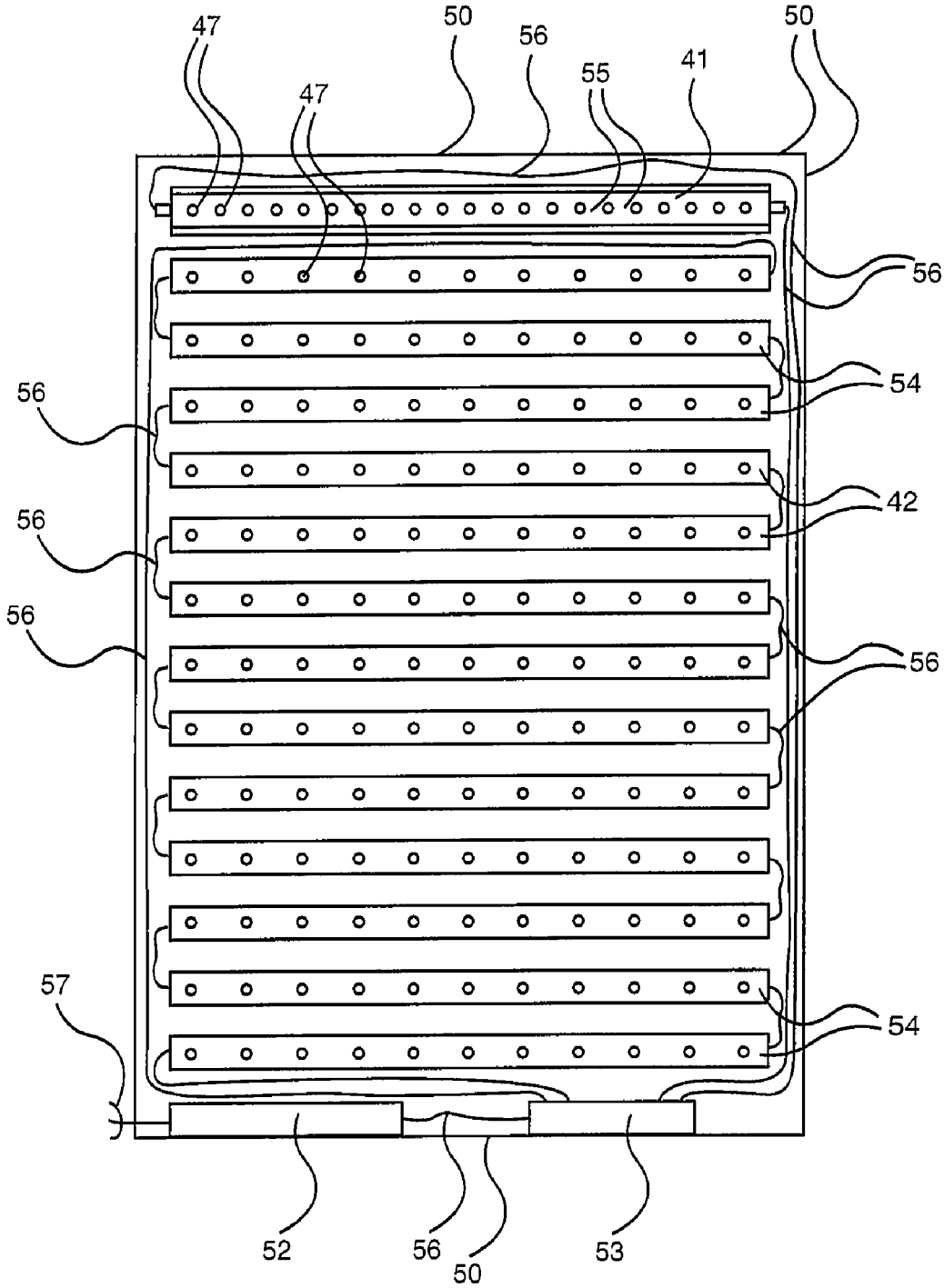

FIG. 10 illustrates front and rear sources of illumination suited to an alternating sign assembly in a sign box 50, for example as illustrated in FIG. 2. Front source of artificial illumination 41 comprises a ribbon of LEDs 47 within an LED bar or tube 55. Rear source of artificial illumination 42 comprises an array of LED ribbons or tapes 54 which are adhered to the rear casing to the sign box 50 by pressure-sensitive adhesive and connected in series by lengths of wire cable 56. Both sources of illumination are connected to alternating switchgear 53 which is supplied by transformer 52 from electrical power source 57. An advantage of the illustrated arrangement is that the spacing of the LED ribbons 54 can be varied to suit the required level of illumination to sufficiently illuminate rear design 36 in order to visually dominate front design 26.

Although the switchgear 53 is illustrated with respect to a particular embodiment, such switchgear can be used with any embodiment to facilitate automated alternating lighting of the front and rear sources of illumination. The switchgear can be constructed and arranged to effect instantaneous complete switching (i.e., completely turning the front source of illumination OFF and completely turning the rear source of illumination ON, and vice versa) or gradual switching (gradually turning the front source of illumination OFF while gradually turning the rear source of illumination ON, and vice versa). The switchgear can be constructed and arranged to alternate the illumination at predetermined intervals (e.g., via a user input that permits a user to select the interval (e.g., 5 seconds, 10 seconds, 30 seconds, 1 minute, etc.). According to various embodiments, the interval is less than 5 minutes, less than 1 minute, less than 35 seconds, less than 20 seconds, less than 10 seconds, and/or less than 5 seconds.

Figure 11A:
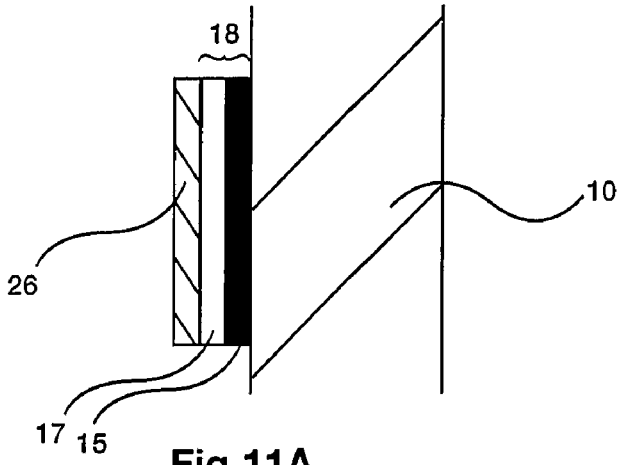
Figure 11B:
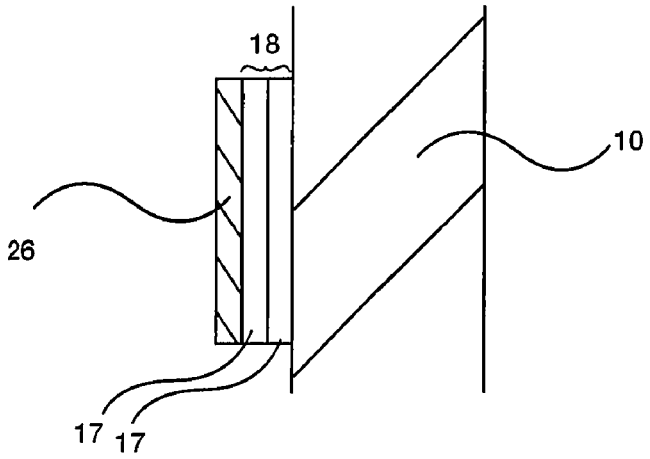
Figure 11C:
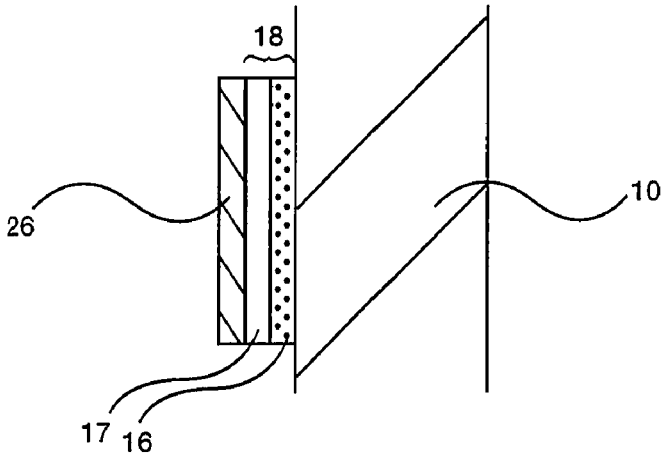

FIG. 11A is a cross-section through an imaged portion of light permeable material 10 comprising a part of front design layer 26 and a part of base layer 18 comprising a white layer 17 and a dark layer 15, typically black, providing an opaque layer to prevent front design 26 being illuminated by rear source of artificial illumination 42. Preferably, however, opaque base layer 18 comprises reflective material, for example a plurality of white layers 17 sufficient to provide an opaque barrier between design layer 26 and rear source of artificial illumination 42, as illustrated in FIG. 11B. Optionally, base layer 18 comprises opaque silver ink layer 16 as illustrated in FIG. 11C. FIG. 11D illustrates the electroluminescent construction in the assembly of FIG. 6, illuminating front design 26, which is applied to the front surface of light permeable material 10, for example a sheet of acrylic, polycarbonate or polyester, to the rear of which is applied a uniform electrically conducted coating 11, typically transparent, for example of indium tin oxide (ITO). An electroluminescent ink layer 12 (commonly known as a "phosphor") is applied directly to the surface of conductive coating 11 on light permeable material 10, followed by a dielectric (electrically insulating) ink layer 13 and conductive ink layer 14 all within silhouette pattern 2, the conductive ink layer 14 typically comprising a conductive silver ink that is also reflective, which has an additional benefit of reflecting the rear source of artificial illumination 42.

It should be understood that the figures, their descriptions and additional features described herein are purely illustrative of some aspects and embodiments of the invention. The different options for the front source of artificial illumination, the front design, the rear design and the rear source of artificial illumination are generally interchangeable to enable a large number of different configurations of the invention.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims.

What is claimed is:

1. An assembly comprising:

a sheet of light permeable material comprising a front surface and a rear surface;

a front design including a front design layer;

a silhouette pattern comprising light-restricting imaging material, said front design being superimposed on or forming a part of the silhouette pattern, said silhouette pattern subdividing said sheet into a plurality of discrete areas of said imaging material and/or a plurality of discrete areas devoid of said imaging material;

a rear design disposed rearwardly of the front design; and a switchable rear source of artificial illumination of said rear design, wherein said rear design comprises a plurality of interlaced images, wherein said front design is applied to said sheet of light permeable material and said rear design is applied to another sheet of light permeable material.

2. An assembly as claimed in claim 1, wherein said plurality of interlaced images are interlaced in a pattern of two, three or four images in sequence.

3. An assembly as claimed in claim 1, wherein said silhouette pattern comprises a pattern of lines parallel to said interlaced images.

4. An assembly as claimed in claim 1, wherein said interlaced images comprise a plurality of frames, and wherein the gaps between said lines are of similar width to the width of a single frame of said plurality of frames.

5. An assembly as claimed in claim 1, wherein a 3-D image of said rear design is visible by means of said rear source of artificial illumination.

6. An assembly as claimed in claim 1, wherein changing images are visible to an observer by means of said rear source of artificial illumination and relative movement between the assembly and an observer.

7. An assembly as claimed in claim 1, wherein said rear source of artificial illumination comprises an array of light sources.

8. An assembly as claimed in claim 7, wherein said array of light sources are linear.

9. An assembly as claimed in claim 7, wherein said array of light sources are point light sources.

10. An assembly as claimed in claim 9, wherein said point light sources comprise a fixed or programmable array of Light Emitting Diodes (LEDs).

11. An assembly as claimed in claim 1, wherein:

wherein said assembly comprises a front source of artificial illumination of said front design; and said front source of artificial illumination is remote from the front design.

12. An assembly as claimed in claim 1, wherein said sheet of light permeable material is remote from said interlaced images.

13. An assembly as claimed in claim 1, wherein said assembly comprises a switchable front source of artificial illumination of said front design.

14. An assembly as claimed in claim 13, wherein said front source of artificial illumination of said front design and said rear source of illumination of said rear design are capable of instantaneous transition.

15. An assembly as claimed in claim 13, wherein said front source of artificial illumination of said front design and said rear source of illumination of said rear design are capable of gradual transition.

16. An assembly as claimed in claim 13, wherein said front source of artificial illumination comprises edge lighting.

17. An assembly as claimed in claim 13, wherein said front source of artificial illumination comprises an electroluminescent layer.

18. An assembly as claimed in claim 1, wherein said front design is applied to said front surface of said sheet of light permeable material.

19. An assembly as claimed in claim 18, wherein said rear design is applied to said rear surface of said sheet of light permeable material.

20. An assembly as claimed in claim 1, wherein said front design is applied to said rear surface of said sheet of light permeable material.

21. An assembly as claimed in claim 1, wherein said rear design comprises a rear design layer illuminated by said rear source of artificial illumination.

22. An assembly as claimed in claim 1, wherein said sheet of light permeable material is imperforate.

23. An assembly as claimed in claim 1, wherein said rear source of artificial illumination comprises LEDs.

24. An assembly as claimed in claim 23, wherein said LEDs comprise a plurality of LED ribbons.

25. An assembly as claimed in claim 1, wherein said assembly further comprises:

a switchable front source of artificial illumination of said front design; and switchgear operatively connected to the switchable front and rear sources of artificial illumination, the switchgear being constructed and arranged to alternately light the front and rear sources of artificial illumination.

26. An assembly as claimed in claim 1, wherein, when the rear source of artificial illumination illuminates the rear design, different ones of the plurality of interlaced images are visible from a front of the assembly at different angles of observation relative to the assembly.

27. An assembly comprising:

a sheet of light permeable material comprising a front surface and a rear surface;

a front design including a front design layer;

a silhouette pattern comprising light-restricting imaging material, said front design being superimposed on or forming a part of the silhouette pattern, said silhouette pattern subdividing said sheet into a plurality of discrete areas of said imaging material and/or a plurality of discrete areas devoid of said imaging material;

a rear design disposed rearwardly of the front design; and a switchable rear source of artificial illumination of said rear design, wherein said rear design comprises a plurality of interlaced images, wherein the rear surface of said silhouette pattern is reflective, and wherein the rear surface of said silhouette pattern is white or silver.

28. A method of using an assembly, the assembly comprising:

a sheet of light permeable material comprising a front surface and a rear surface;

a front design including a front design layer;

a silhouette pattern comprising light-restricting imaging material, said front design being superimposed on or forming a part of the silhouette pattern, said silhouette pattern subdividing said sheet into a plurality of discrete areas of said imaging material and/or a plurality of discrete areas devoid of said imaging material;

a rear design disposed rearwardly of the front design; and a switchable rear source of artificial illumination of said rear design, wherein said rear design comprises a plurality of interlaced images, the method comprising switching said rear source of artificial illumination such that the front design and said rear design are alternately visible from in front of the assembly.

29. The method of claim 28, wherein an observer is located in front of said assembly and observes the alternating visibility of the front and rear designs.

30. The method of claim 28, wherein said front design is alternated with a 3D rear design formed by said plurality of interlaced images.

31. The method of claim 28, wherein said front design is alternated with a changing rear design, and wherein said changing rear design is visible to an observer by means of said rear source of artificial illumination and relative movement between the assembly and the observer.

32. The method of claim 28, further comprising making different ones of the plurality of interlaced images visible at different angles of observation relative to the assembly when the rear source of artificial illumination illuminates the rear design.

* * * * *